US005419287A

United States Patent [19]

Evans

[11] Patent Number: 5,419,287

[45] Date of Patent: May 30, 1995

[54] ENGINE COOLING SYSTEM AND HEATER CIRCUIT THEREFOR

[76] Inventor: John W. Evans, 253 Rte. 41 North, Sharon, Conn. 06069

[21] Appl. No.: 155,709

[22] Filed: Nov. 22, 1993

Related U.S. Application Data

[63] Continuation-in-part of Ser. No. 947,143, Sep. 18, 1992, abandoned.

[51] Int. Cl.[6] ..... F01P 3/00

[52] U.S. Cl. ..... 123/41.29; 123/41.01; 165/101

[58] Field of Search ..... 123/41.01, 41.1, 41.29, 123/41.31; 165/101; 237/12.3 B

[56] References Cited

U.S. PATENT DOCUMENTS 5,031,579 7/1991 Evans ..... 123/41.2

FOREIGN PATENT DOCUMENTS 59-11908 1/1984 Japan ..... 237/12.3 B

*Primary Examiner*—Noah P. Kamen

*Attorney, Agent, or Firm*—Dressler, Goldsmith, Shore & Milnamow, Ltd.

[57] ABSTRACT

A heating system for a vehicle having an internal combustion engine comprising a cylinder head defining an upper coolant chamber and a cylinder block defining a lower coolant chamber. A heater has an inlet in fluid flow communication with the lower coolant chamber of the engine and an outlet connected to a high point of the lower coolant chamber of the engine. A pump has a low pressure side connected to the lower coolant chamber of the engine and a high pressure side connected to a radiator and to the heater. A nonvariable in-line flow restrictor is disposed between the high pressure side of the pump and the heater for limiting coolant pressure on said heater at all flow rates of said pump.

2 Claims, 2 Drawing Sheets

2/2

ENGINE COOLING SYSTEM AND HEATER CIRCUIT THEREFOR

BACKGROUND OF THE INVENTION

This application is a continuation-in-part of my application Ser. No. 947,143, filed Sep. 18, 1992, now abandoned.

Vaporized coolant in an internal combustion engine passing from the engine cooling chambers with liquid coolant into the circuitry for the passenger compartment heater or an ancillary auxiliary heat exchanger, (such as a liquid to liquid oil cooler, throttle body heater, inter-cooler, etc.), has long been known to: 1) Limit the heat transfer on the liquid coolant side of such components, and 2) Often cause serious internal component damage due to vapor scrubbing, commonly termed cavitation damage and on occasion has been the source of heater circuit "knocking" which is the audible knock produced when the vapor collapses violently within the heater, or an ancillary coolant regulated heat exchanger (i.e., oil cooler or throttle body heater, etc.), or any of the attached conduits.

Coolant vapor suspended in the coolant passing through the core of the heater or in the heat transfer area of the body of an auxiliary heat exchanger (oil cooler, throttle body, etc.) will significantly interfere with the ability of the coolant to transfer heat, at the coolant to metal interface, in either direction; from the coolant to the metal (when used to heat the opposed side, i.e., passenger heater) or from the metal to the coolant (when used to cool the opposed side, i.e., oil cooler). Whenever the coolant vapor contacts the metal surface, in the heater or exchanger, an immediate vapor (gas) barrier is established, at the liquid to metal interface, and the ability of the coolant to transfer heat to the metal is virtually eliminated. The dynamics of the vapor passing through the core and exchangers and its effect on limiting the transfer of heat is as follows: The vapor, passing within the liquid coolant will move outward toward the metal wall as the narrow passages of the core area straighten and accelerate the coolant flow and a laminar flow condition is established. The laminar flow of the coolant is a smooth and orderly straight-line flow along the metal wall which forces the vapor outwardly to the metal wall and enhances the natural tendency of the vapor to move toward the metal surface. The natural tendency of the vapor to move toward the wall is related to the surface tension characteristics of the liquid coolant. A high surface tension in a coolant, such as water, causes the vapor to have an increased affinity to "cling" to the metal surface and in such aqueous coolants the accumulating of the vapor bubbles, on the metal surface, results in the progressive increase in a gas barrier at different locations along the metal surface. The gas barrier, of the vapor bubbles, forces coolant away from the metal surface, at the liquid to metal interface, and the metal surface momentarily becomes "dry" of coolant and heat exchange is reduced or eliminated in that area. Such aqueous coolants which have high surface tension characteristics, and tend to "vapor-dry" the metal surface are termed as having a low tendency to wet the surface. Nonaqueous coolants, such as substantially water-free propylene glycol, which have low surface tension characteristics and whose vapor does not readily "cling," are termed as having a high tendency to wet the surface. The use of a water-free coolant, with low surface tension vapor, such as propylene glycol does help to improve the liquid to metal heat transfer at the metal interface, however as long as any form of vapor exists in the heater or auxiliary exchanger circuits there will be a loss in the ability of those circuits to exchange heat.

Damage caused from the scrubbing, or erosion, of the heater or auxiliary exchanger internal metal surface by coolant vapor, which is commonly referred to as cavitation damage, is caused by the rapid collapse of the vapor while it is in contact with the metal surface. This is often evidenced along the interface wall through the heater or auxiliary exchanger, and most often at the entrance to the core tubes where the vapor is subjected to increased speed, and pressure, and rapid change in direction. It is commonplace to see the attachment points for the heater or auxiliary exchanger core tubes completely eroded away, at the tube entrance, which is often the cause for leaks and failures. Cavitation damage from vapor occurs when the vapor pressure within the liquid at localized sites falls below its vapor pressure point when vapor is suspended in the liquid. It is widely accepted that the damage is caused by high impact collapse or implosion of the bubbles (which nearly approaches sonic speeds) at or near the metal surface. Each instance of high speed impact from vapor implosion, at the metal surface, removes a minute but significant amount of metal. The impact of the almost sonic speed collision on the metal wall, when of significant proportion, is also the source of the previously referred to heater circuit "knock" which is the audible evidence of the violent effect which vapor cavitation damage has when occurring within the system.

Additionally, when coolant high flow volumes are employed in a cooling system then excessive auxiliary heat exchanger core flow rates will exist unless properly restricted. If left unrestricted the amount of heat exchanged will be reduced, within the exchanger core, due to insufficient time for the coolant to remain and transfer heat within the exchanger core, because of it's rapid passage through the core area. Furthermore, core rupturing will often result from the excessive pressure exerted within the core due to the high coolant flow rates and pump pressures. Also, certain coolant additives such as phosphates, borates, and silicates are abrasive when dissolved in typical engine coolant and will cause erosion damage to the core tube ends when passed, with the coolant, at high flow rates through the exchanger core. The amount of core erosion damage is in an increasing proportion to the degree of elevation of the coolant flow rate. Such high flow volumes of coolant through ancillary heat exchanger circuits, if not properly restricted, will also act as a by-pass circuit of the main coolant circuit for the radiator, and will cause a loss of coolant heat rejection to the radiator circuit which will result in the engine running excessively hot during periods of high ambients and/or engine loads.

The damages and cooling losses discussed above, due to high coolant flow volumes, are typically always observed at all temperature settings in an auxiliary exchanger circuit which is operated at full coolant flow without a liquid-side variable heat control valve (air-side temperature control systems). However, such damages and losses are also observed in such circuits with liquid-side variable setting control valves (liquid-side temperature control) when the valves are operated at the "majority" open, to the "full" open position.

Lastly, a major cause for the delay in the ability of the ancillary heat exchanger circuits to receive hot coolant, during early stages of engine warm-up, and discharge heat to their respective areas, i.e., passenger compartment, is the mixing and diluting of the hot and cold coolants from separate regions of the coolant mass during engine warm-up. As coolant flows through the engine, coolant temperature which rises the quickest is that coolant which passes through the high heat flux combustion chamber areas of the engine. However, once heated to a given level it is reduced in temperature by dilution as it is mixed with the colder coolant from the lower heat-flux areas, of the cylinder block, before passing to the ancillary heat exchanger circuit. Such mixing of the mass coolant, during warm-up, has been traditionally a major limitation in the efficiency of ancillary heat exchanger systems and circuitry of past and currently employed cooling systems including my U.S. Pat. Nos. 4,550,694, 5,031,579 and 5,255,636.

SUMMARY OF THE INVENTION

The first of the aforesaid problems are solved, in accordance with the present invention, by either minimizing or totally eliminating the passage of vapor through the heater or auxiliary heat exchange circuits, thereby increasing their efficiency.

Thus, the damaging effect of vapor cavitation within the heater and auxiliary exchanger circuits, and the audible sound of heater circuit "knock" evidenced when such vapor cavitation occurs, is eliminated.

Additionally, the other aforesaid problems of "abrasive additive," core erosion and core rupture, caused by high coolant flow and pressure, as well as the problems of losses in heat exchange efficiency of the core (excessive coolant flow) and the engine (excessive bypassing) are also solved in accordance with the present invention with circuitry which restricts the coolant flow and coolant bypassing to acceptable levels at all operating conditions of the engine.

Lastly, the final aforesaid problem with delayed ancillary exchanger warm-up due to the hot coolant fraction supplied to the exchanger being diluted with the colder coolant fraction, of the mass coolant, is solved, in accordance with the present invention by unique constructions which only supply the hottest coolant fraction to the ancillary exchanger during engine warm-up periods.

The objective stated above is accomplished in one embodiment of the present invention by a unique heater/exchanger circuitry which completely eliminates the requirement, heretofore universally accepted and practiced, that the circuit for the passenger heater and auxiliary heat exchangers must originate from an elevated engine cooling chamber wherein the highest heat exchange to the engine cooling system exists. The fallacy of this practice is that in conventional cooling systems such points of origination are almost always in the upper region of the cylinder heat cooling chamber where a significant amount of vapor periodically exists. Therefore, the coolant pump, which is usually connected directly to the opposite end of the heat exchanger circuitry, will draw hot liquid coolant from the cylinder head which will periodically be saturated with vapor at many operating modes of the engine. The action of the pump will then result in the vapor, suspended in the hot coolant, being drawn directly into the heater or auxiliary exchanger cores.

The source of coolant vapor, as referred to above in the description of the suspended vapor's debilitating and damaging effects on the heater and auxiliary exchangers, and methods for controlling and handling such vapors produced are the subject of my U.S. Pat. Nos. 4,630,572, 4,550,694, 5,031,579 and 5,255,636. Engine cooling systems constructed to the specifications as detailed in the disclosure of those patents and adapted to be used in combination with the apparatus and circuitry structures disclosed, in the figures which follow, will operate with the heater core and other ancillary auxiliary heat exchangers (i.e., liquid to liquid oil coolers, throttle body heaters, intercoolers, etc.), substantially free of coolant vapor at all engine operating speeds and loads. Losses in heat exchange efficiency, due to suspended vapor in the liquid coolant, will be corrected, and related coolant vapor cavitation damage and audible heater circuit "knock" will be substantially eliminated.

In another embodiment of the present invention the objectives stated above of eliminating core erosion due to passage of abrasive additives suspended in coolants at high flow rates, and core rupture due to coolant high flow rates and pressure, as well as lost efficiency of heat exchange in the ancillary circuits (excessive flow and bypassing) are accomplished by the employment of a unique system of flow restrictive circuitry. The restricted circuits are balanced for use with or without liquid-side temperature control valves. Additionally, the circuits are restricted to operate at a predetermined flow rate which will, when used with either aqueous or nonaqueous coolants, substantially eliminate the occurrence of core additive erosion or rupture, and heat exchange losses due to core high coolant flow rates or excessive bypassing of the main radiator circuit.

In yet another embodiment of the present invention, the above stated objective of improving the delay in heater and ancillary heat exchanger warm-up time is accomplished by unique heater and ancillary exchanger circuitry employed with reverse flow dedicated head chamber to heater and ancillary exchanger flow, or the reverse flow segregated cooling chamber constructions as detailed in my copending application Ser. No. 134,212, filed Oct. 8, 1993. Reverse flow chamber segregation substantially minimizes the mixing of the hottest fraction, of the mass coolant, with the colder fraction and thereby directs the hottest coolant from the combustion chamber area, substantially undiluted by coolant from around the cylinder bore area, to pass out of the engine directly to the heater and ancillary heat exchanger.

DETAILED DESCRIPTION OF THE PREFERRED EMBODIMENT(S)

Figure 1:
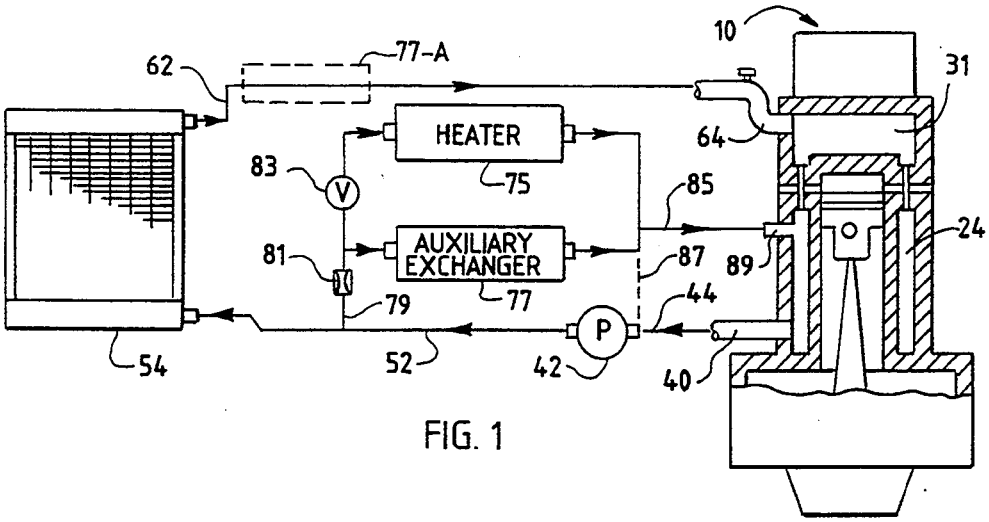
FIG. 1 is a schematic view of an engine and a reverse flow cooling circuit having a heater and auxiliary heat exchanger therein.

As seen in FIG. 1, an engine 10 is provided with a heater 75 and an auxiliary heat exchanger 77 which operate, in accordance with the present invention, substantially free of vaporized coolant. The unique circuitry of FIG. 1 can be employed with all nonaqueous coolants, which typically have high boiling points, high molar heat of vaporization and low surface tension, as described in my previously issued patents. When the coolant is flowed in the reverse direction of that currently used in most production engines, the coolant passes from the radiator 54, enters the engine 10 through an inlet 64 at a high point of coolant chambers 24 and 31, passes downwardly from the cylinder head cooling chamber 31 to the lower chamber 24 and out of the engine 10 through the outlet conduit 40. As disclosed in my U.S. Pat. Nos. 4,550,694 and 5,031,579, the use of a proper nonaqueous coolant and corresponding adaptive apparatus will assure that no coolant vapor will exist in the lower cooling chamber 24 and that only vapor free coolant will exit the engine 10 by way of conduit 40. The coolant pump 42 will therefore only draw hot liquid coolant (which is free of vapor) through line 44 and push the coolant, under relatively elevated pressure mechanically induced by pump 42, to the radiator 54 by way of connecting line 52. The heater 75 and auxiliary heat exchanger 77 circuitry is in communication with the coolant at an elevated pressure in line 52 by way of connecting line 79.

Additionally, when the higher coolant flow rates are employed, as disclosed in various configurations of my previous patents, the pressure and flow in line 52 is raised significantly. In such cases a means of flow restriction must be employed as is represented as an in-line flow restrictor 81 placed in connecting line 79. The restrictor is employed to reduce the pressure and volume of coolant flowing through the heater 75 and the auxiliary exchanger 77. Excessive pressure and coolant flow is well known to be a cause of severe damage to the small cores of such circuits. The damage caused by high coolant flow rates is related to additives in the coolant which are abrasive and tend to erode the exchanger ends if passed through at high coolant flow rates. Additionally, excessive pressure acting independently of or with high coolant flow can cause rupturing of exchanger cores. The proper employment of the flow restrictor 81 assures that such damage does not occur.

Typically a system as depicted in FIG. 1 and employed on an average 5.0 to 5.5 liter displacement engine would flow 75 to 100 gpm at 4500 rpm through coolant line 52 and at the same time would need only between 2 and 4 gpm through the heater 75 or auxiliary exchanger 77. Preferably, a flow control valve 83 is used to control the temperature level of the heater 75 and is typically designed to completely block flow in the "off" position to avoid hot weather coolant flow through the heater 75, which creates a bypass for the hot coolant around the radiator by flowing hot coolant from line 52, through line 79 and heater 75, passing on through line 85 back to the engine at a connecting point 89 which is at a lower pressure than line 79.

Even though there would be some inherent ability of the flow control valve 83 to act as a flow restriction, such as shown as in-line restrictor 81, it would only function as such during periods of operation for low heater 75 output when the control valve 83 would be at its most restrictive setting, typically settings of one half open or less. During periods of settings typically ranging between half open to full open, which are the majority of the normal use of heater 75, the valve opening would be sufficient enough to allow excessive coolant flow, pressure, and bypassing to reach the critical values. Core damage to heater 75 and auxiliary exchanger 77 and significant radiator 54 heat transfer losses will occur if a means of flow control is not employed, such as the in-line restrictor 81 shown, in addition to the control valve 83. The in-line restrictor 81 is merely one means of many methods which could be employed to establish acceptable coolant flow rates and pressures within the heater 75 and exchanger 77 cores. Pump and line placement, in reverse flow cooling systems, may be used to reduce the differential pressure across the heater 75 and exchanger 77 which will also achieve the objectives of the present invention, and will be discussed in more detail below in FIGS. 2 and 4.

Alternately, coolant out of the heater 75 and auxiliary exchanger 77 may be returned to the pump 42 inlet or inlet line 44 by means of an alternate line 87. The control valve 83 may also be moved to the outlet side of heater 75, if so desired, and in addition a similar valve may be employed at either the coolant inlet or outlet of the auxiliary exchanger 77 for periods during which its use may be negated and it becomes necessary to increase the coolant flow through radiator 54.

When used as an oil cooler, an intercooler, or the like wherein coolant is used to absorb heat in the core, the auxiliary exchanger 77-A, shown as dotted lines, may ideally be relocated to the radiator outlet line 62 in order to gain the advantage of the lower temperature level of the coolant exiting radiator 54.

Figure 2:
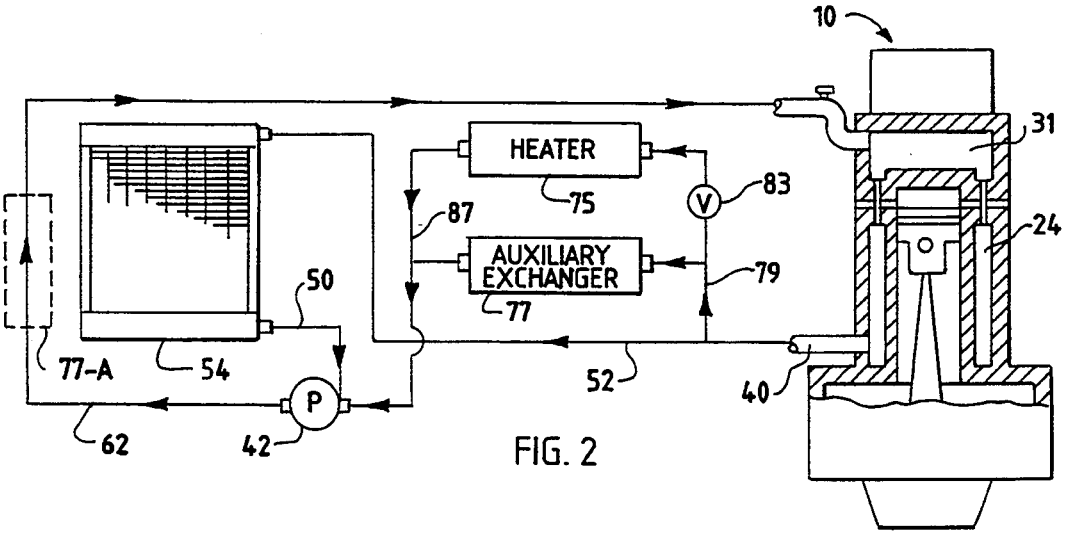
FIG. 2 is a view similar to FIG. 1, of another embodiment of the invention with a reverse flow circuit.

FIG. 2 depicts an engine 10 with a heater 75 and auxiliary heat exchanger circuit 77 adapted to operate similarly to the objectives of the system as depicted in FIG. 1 but configured to function with the coolant pump 42 drawing coolant, in the reverse flow direction, from the radiator 54 rather than directly from the lower cooling chamber 24 as in FIG. 1. This configuration is ideally suited for all nonaqueous coolants as disclosed in my previously issued patents and is the preferable system for the aqueous reverse flow system disclosed in my U.S. Pat. No. 5,255,636. As in the circuitry of FIG. 1, the objectives of eliminating the passage of vapor into the heater 75 and auxiliary exchanger 77 circuitry are met by the unique circuitry of the heater/exchanger as applied to my previously disclosed cooling systems. Specifically, vaporized coolant will not exist in the lower cooling chamber 24 and therefore will not exit the engine 10 with the hot coolant at the outlet conduit 40 for several reasons as disclosed in my previous patents and copending applications;

1) With the reverse flow techniques, as disclosed, whereby the coolant flow rate of a nonaqueous coolant into the chamber 31 is sufficient to condense all coolant vapor generated; there is no coolant vapor passed to chamber 24, 2) With slower nonaqueous coolant reverse flow rates where vaporized coolant is not condensed in chamber 31, a condenser circuit is used to receive all vapor which exits chamber 31, and therefore no vapor is passed to chamber 24, and 3) With an aqueous reverse flow cooling system where considerable amounts of coolant vapor are produced and must have a means to exit the upper chamber 31, a unique separator condenser circuit is employed to receive and condense all the vapor, and no vapor is therefore passed to chamber 24.

The major difference caused by the placement of pump 42 to draw upon line 50 from the radiator 54 which would in turn receive the hot coolant coming out of engine 10 by way of line 52 which is connected to line 40 is that the heater 75 and exchanger 77 circuit must then be connected to the inlet side of the pump 42 at the outlet side of the circuit by line 87. Hot coolant is drawn through the heater 75 and exchanger 77 circuit from line 52 through connecting line 79 instead of receiving lower temperature coolant if connected after coolant pump 42. When located as shown and operated as a draw-through circuit, the need for a restrictor 81 as shown in FIG. 1 is often negated because the draw side of the pump 42 is significantly less efficient than the positive pressure side. However, if the flow is found to be excessive, a restrictor may be employed at any point in the heater/exchanger circuitry in that there is no elevated pressure in the circuit and no need to place the restrictor before the cores.

Because excessive high coolant flow can, at times, still exist even though acceptable coolant pressures are maintained in heater 75 and exchanger 77, when the exchangers are on the "Draw" side of pump 42, then a flow restriction (such as FIG. 1 restrictor 81) must be employed at some point before pump 42. When present and if not controlled such excessive flow rates, even absent of high pressure will cause the abrasive additive core erosion damage which has been previously described.

A flow valve operating in the same manner as the valve described in FIG. 1 may be employed for the heater 75, the exchanger 77, or both. Additionally, if the exchanger 77 is used as an oil cooler, or an intercooler designed to cool the core, it may be more suitably moved to an alternate location in line 62 at new point 77-A where the coolant temperature is lower.

Figure 3:
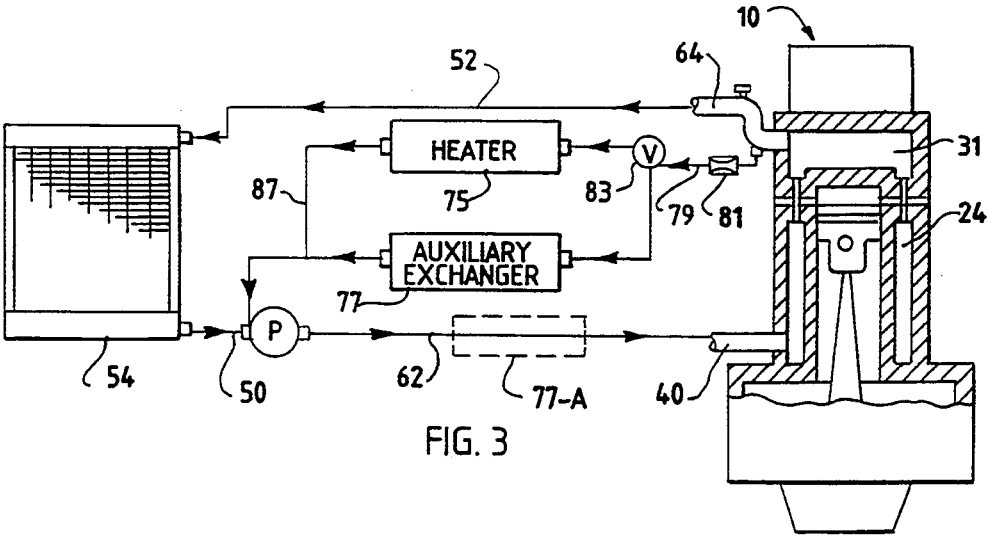
FIG. 3 is a view, similar to FIG. 1, of yet another embodiment of the invention with a conventional flow circuit.

FIG. 3 depicts an engine 10 with a heater 75 and auxiliary heat exchanger circuit 77 adapted to operate similarly to the objectives of the systems as depicted in both FIGS. 1 and 2 but uniquely configured to operate in a vapor free state exclusively with the conventional flow coolant direction into the lower chamber 24 and up to and out the upper chamber 31 of a nonaqueous cooling system as disclosed in my issued U.S. Pat. No. 5,031,579. As disclosed in that previously issued patent, coolant vapor will be readily condensed, under all operating loads of engine 10, within the upper cooling chamber 31. With the coolants described and the flow rates employed, as disclosed in the patent, coolant vapor never exists in the upper regions of chamber 31 and will never exit out of the outlet conduit 64. Therefore, the attachment of the heater 75 and auxiliary exchanger 77 circuit connecting line 79 to the coolant outlet conduit 64 will assure that the hottest coolant completely free of coolant vapor will always pass to the heater 75 and auxiliary exchanger 77.

The higher coolant flow rates of the system as disclosed in my patents discussed hereinbefore may cause an elevated coolant flow rate and pressure condition in the engine coolant outlet line 52 and outlet conduit 64. Because of the elevated coolant pressure and flow, a restrictor 81 as described in FIG. 1, is preferably employed in the connecting line 79 in order to lower the coolant pressure and flow rate internal to the heater 75 and auxiliary exchanger 77 cores. Moreover, a flow control valve 83, for temperature level control, may be employed in line 79 as shown for heater control. Alternately, an additional valve may be used on the auxiliary exchanger 77. Either valve may be moved to the outlet side of the heater 75 or exchanger 77 and be connected to line 87, which connects finally to the pump 42 inlet or to line 50.

Even when employing the use of control valve 83 in order to minimize damage to the exchanger cores and a loss in heat transfer efficiency of radiator 54, due to high coolant flow rates, pressure, and bypassing a restriction means, shown as restrictor 81, must be employed, as described previously in FIG. 1 for operating positions of valve 83 typically between one half and full open.

If the auxiliary heat exchanger 77 is to be used as a cooling circuit, i.e., oil cooler, intercooler, etc., it would preferably be relocated to the radiator outlet line 62 at the new location shown as 77-A which would pass the lowest temperature coolant through the core as it returns from the radiator 54, through line 62 and into the engine 10 at conduit 40.

Figure 4:
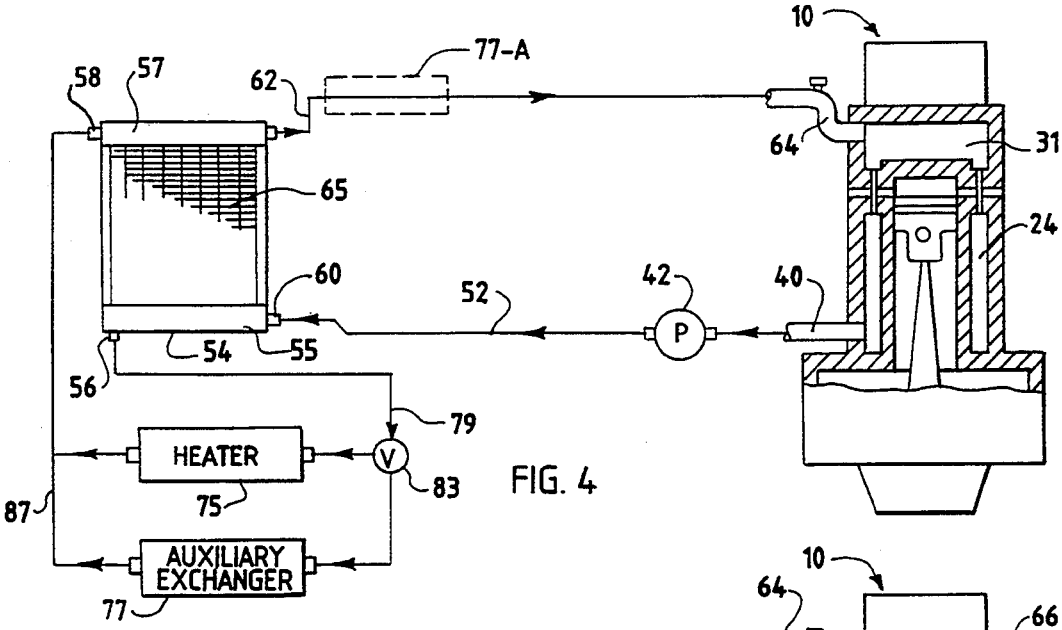
FIG. 4 is a view, similar FIG. 1 of yet another embodiment of the invention for flow restriction by predetermined attachment point differential pressures.

FIG. 4 depicts an engine 10 with a heater 75 and auxiliary heat exchanger 77 adapted to operate similarly to the objectives of the systems as depicted in FIGS. 1 and 2 but uniquely configured to operate the heater 75 and exchanger 77 in a vapor free state, remaining substantially free of damage and radiator losses, at acceptable levels of coolant flow rate, pressure, and bypassing by means of selectively attacking the input line 79 and output line 87 at predetermined locations 56 and 58 respectively which determine an acceptable predetermined differential pressure value.

The outlet port 56 is attached at a remote location from the main inlet 60 in the hot tank 55 of the radiator 54. The coolant pressure exerted upon line 52 by the coolant pump 42 would be at a reduced level within the hot tank 55 due to the expansion chamber effect of the header tank construction and the pressure drop caused by the passage of coolant out of the hot tank 55 into the tubes of the radiator core 65. The pressure drop in the hot tank 55 will increase across the length of the tank in proportion to the flow of coolant out into the core 65. Therefore the available pressure and coolant flow at the outlet port 56 side of the hot tank 55 is much less than at the main inlet 60 side of tank 55.

The connecting line 79 for the inlets to the heater 75 and exchanger 77 is therefore attached to the outlet port 56 of tank 55 at a predetermined location whereby the reduced coolant pressure at outlet port 56 will establish an acceptable coolant flow rate and pressure through the connecting line 79 to valve 83 through the heater 75 and exchanger 77 and pass out connecting line 87 to the inlet port 58 to the cold tank 57 which will be at a lower pressure than the hot tank 55 thereby establishing a differential pressure across line 79 and 87 respectively and coolant flow through the heater 75 and exchanger 77. The proper placement of the outlet port 56 and inlet port 58 will establish coolant flow rates and pressure levels, with controlled bypassing of the radiator 54 whereby the objectives of core erosion, rupture, and heat exchange loss (excessive flow) as well as radiator 54 efficiency (excessive bypassing) will be met.

Figure 5:
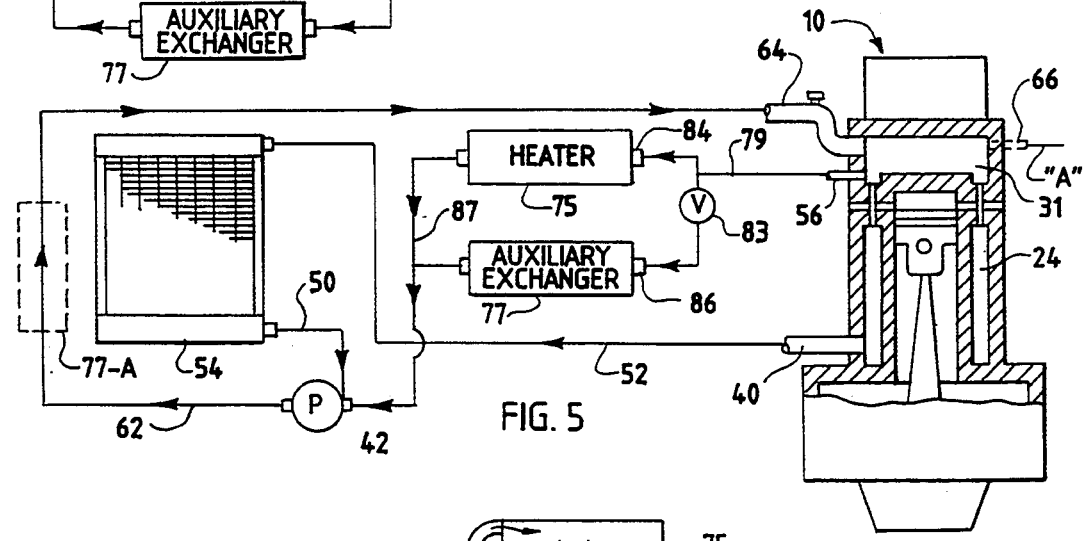
FIG. 5 is a view, similar to FIG. 1 of yet another embodiment of the invention for reverse flow dedicated head chamber to heater and ancillary exchanger coolant flow.

FIG. 5 depicts an engine 10 with a heater 75 and auxiliary heat exchanger 77 circuit adapted to operate similarly to the objectives of the systems as depicted in FIGS. 1, 2 and 4, but uniquely configured to substantially reduce the delay in the warm-up rate of the heater 75 and exchanger 77 during the warm-up cycle of the engine 10 constructed with a reverse flow cooling system similar to those described in my U.S. Pat. Nos. 4,550,694, 5,031,579 and 5,255,636.

The outlet 56 from the cylinder head cooling chamber 31 is connected directly to the inlets 84 and 86 of the heater 75 and exchanger 77. The coolant pump 42 acting upon connecting line 87 will draw upon the heater 75 and exchanger 77 and cause hot coolant to flow out of chamber 31 through port 56, and through the heater 75 and exchanger 77.

A reverse flow system proportioning type thermostat, as disclosed in my U.S. Patents listed above and copending applications Ser. No. 134,212 and 947,144, would be placed between, and caused to act upon engine 10 coolant inlet 64, outlet 40 and coolant pump 42. As described, coolant during warm-up of the engine 10, would pass at full flow from coolant pump 42 in a closed loop to the head chamber 31, down through the block coolant chamber 24, and back to the pump 42 until the fully warmed-up, predetermined temperature level for engine 10 is achieved and coolant is allowed to pass to radiator 54 in proportional amounts to the cooling required while the balance of pump 42 coolant flow is bypassed back to chamber 31 of engine 10 wherein the cycle is repeated continuously.

Typically 85% of the heat rejection of the engine 10 is to the coolant within the head cooling chamber 31 while only 15% is to the coolant in the block chamber 24 which is the larger fraction of the coolant mass. Therefore, the smaller fraction of head coolant from within chamber 31 which has been raised to a high heat level, while passing through chamber 31, is immediately lowered in temperature as it is mixed with and diluted by the larger mass of colder coolant in the block chamber 24. In my previous patents, listed earlier, detailing reverse flow cooling systems and in the previous FIGS. 1, 2 and 4 of the present application, the circuits as described and depicted all required that the head chamber 31 coolant be passed totally through the block coolant chamber 24 thereby mixing the head chamber 31 fraction of coolant with the block chamber 24 coolant before passing out conduit 40 to the heater 75 and exchanger 77.

When nonaqueous coolants are employed in a reverse flow cooling system as described in my earlier patents, then the cooling chamber 31 will operate substantially free of vapor at all operating temperature and loads of engine 10. With the chamber 31 free of vapor then the outlet port 56 can be moved to any location in the head chamber 31. A minor fraction of the hottest coolant from chamber 31 will therefore be drawn out of chamber 31, without passing onto chamber 24 with the remaining bulk of the coolant from chamber 31. The minor hot coolant fraction of chamber 31 undiluted by coolant in chamber 24, will pass out of port 56 to connecting line 79 and into the heater 75 and exchanger 77 effecting a substantial reduction in the previously described delayed warm-up rate of heater 75 and exchanger 77 caused by the dilution of the hot head chamber 31 coolant by the block chamber 24 coolant.

The substantially vapor free nonaqueous coolant passing out of port 56 will also allow the improved warm-up configuration of the present invention to retain all the other objectives of the present invention whereby vapor erosion and blocking of heat transfer of the core tubes will be eliminated and damage due to excessive coolant flow, pressure, and bypassing can be controlled by the many various features of FIGS. 1–4 when employed with the features of this embodiment.

The temperature control valve 83 may, or may not be employed dependent upon the selection of "air-side" or "liquid-side" temperature control, as previously discussed and as configured in the description of FIG. 1.

Additionally, with attention to the location of outlet 56, the features and construction of this embodiment of the present invention may be obtained when applied to the aqueous reverse flow cooling system and engine as described in my U.S. Pat. No. 5,255,636 and copending application Ser. No. 134,212, filed Oct. 8, 1993. Specifically, when aqueous coolants are used a vapor reduction means for chamber 31 must exist, such as the vapor outlet 66 (shown in silhouette) to the vapor/gas separate circuitry as described in my previous patent and application. The vapor reduction means assures that gases within chamber 31 exist only as a minor fraction of the coolant chamber volume and that the lower combustion chamber 31 cooling area below level "A" remains in a liquid state, substantially free of a major fraction of vapor at all times. The various means for accomplishing such a substantially vapor free state are detailed as major objectives of the previous patent and copending application. Therefore, if the placement of the outlet 56 to the heater and auxiliary exchanger circuit is placed at a low point (as shown) within the cooling chamber 31 then the outlet 56 will remain within the area of chamber 31 which remains liquid and substantially free of a major vapor fraction below level "A." The substantially vapor free liquid passing out of the outlet 56 will allow this embodiment for the improved warm-up objectives of the present invention to retain the other objectives, of the invention, whereby vapor erosion and heat transfer limitations of the core tubes within the heater 75 and exchanger 77 will be eliminated and the damage due to excessive coolant flow, pressure, and bypassing can be controlled by the many various features of FIGS. 1–4.

Lastly, the objectives of coolant flow and pressure control by selective placement of the connection locations for inlet line 79 and outlet line 87, as detailed in FIG. 5, may also be met in this embodiment for both aqueous and nonaqueous coolants. Similar to the description of FIG. 5 the pump 42 will draw coolant through the heater 75 and exchanger 77 by means of conduit 87. A differential pressure would therefore exist between chamber 31 and line 87 causing flow and obtaining all the same objectives as detailed in FIG. 5. The temperature control valve 83 may or may not be employed dependent upon the selection of "air-side" or "liquid-side" temperature control as previously discussed as configured in the description of FIG. 1.

Figure 6:
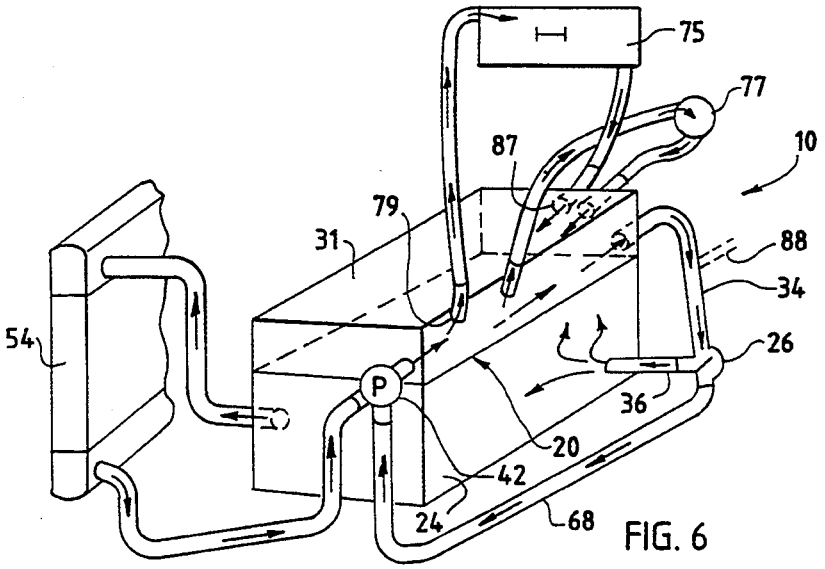
FIG. 6 is a schematic of yet another embodiment of the invention for an engine and cooling circuit having segregated coolant chambers and a heater and auxiliary heat exchanger circuit attached thereto.

FIG. 6 is an alternate embodiment of the reverse flow cooled engine 10 with the heater 75 and auxiliary exchanger 77 circuit adapted to operate similarly to the objectives of the improved warm-up system as depicted in FIG. 5 but uniquely configured to further improve the warm-up rate of the heater 75 and exchanger 77 by deployment of the engine 10 construction as detailed in my copending application Ser. No. 134,212 for segregated cooling chambers of an aqueous reverse flow cooling system.

As detailed in the copending application the head cooling chambers 31 and the block cooling chambers 24 are substantially segregated from each other by a solid head gasket 20. During warm-up of the engine 10 the pump 42 will only circulate coolant out of and back into chamber 31 completely avoiding the coolant in the block chamber 24 in a closed loop for the head chamber 31 only. Specifically, with the proportioning thermostat 26 completely closing line 36, during warm-up, substantially all heated coolant is drawn out of chamber 31 through line 34 into thermostat 26, then through line 68 back into pump 42 and finally back into chamber 31. The coolant circulation will continue in this "closed loop head chamber only" cycle, until the threshold level of complete warm-up is achieved at thermostat 26. Only upon achieving full warm-up of chamber 31 will there be any mixing of the head chamber 31 coolant fraction with the block chamber coolant fraction. However, by design of the thermostat 26 and as detailed in my U.S. Pat. Nos. 4,550,694, 5,031,579, and 5,255,636, and copending applications Ser. Nos. 947,144 and 134,212, the thermostat 26 will gradually blend the coolants of chambers 24 and 31 in proportional amounts assuring that the head chamber 31 remains at peak thermostat setting while the block chambers 24 are raised to their proper operating temperature, and that substantially full pump 42 coolant flow is passed through the head chamber 31 during the entire warm-up period and thereafter.

With head chamber 31 circulation only, during warm-up, the smaller coolant fraction in chamber 31 is exposed to approximately 85% of the engine 10 heat rejection and in turn continues to store substantially all the heat rejected until the thermostat 26 starts to flow coolant to the block chamber 24 and radiator 54. Therefore, the shortest temperature rise time is established for the coolant in chamber 31. Therefore, with the heater 75 and exchanger 77 inlets 79 connected to the segregated head cooling chamber 31 and returning through the outlets 87 the heater 75 and exchanger 77 will rise in temperature, with the coolant within chamber 31, at a rate which is superior to the embodiments of FIGS. 1–5. Alternately the outlet 87 may be connected to conduit 34 at connection 88 (shown in silhouette) if a greater differential (pump 42 "draw") is required than that which exists across the length of chamber 31. This embodiment is ideally suited for applications wherein non-aqueous coolants are used, and the chamber 31 remains substantially free of vapor as disclosed in my previous U.S. Pat. Nos. 4,550,694 and 5,031,579. However, if aqueous coolants are the coolant of choice then vapor reduction circuits, as disclosed in FIG. 5 must be employed, as in my U.S. Pat. Nos. 5,255,636 and application Ser. No. 134,212, filed Oct. 8, 1993, so that all the objectives of the present invention may be obtained.

While the preferred embodiment of the invention has been disclosed, it should be appreciated that the invention is susceptible of modification without departing from the scope of the following claims.

I claim:

1. In a heating system for a vehicle having an internal combustion engine with a reverse flow cooling system, said cooling system comprising a cylinder head on said engine defining an upper coolant chamber, a cylinder block on said engine defining a lower coolant chamber, and a radiator having an inlet communicating with the lower coolant chamber of said engine and an outlet communicating with the upper coolant chamber of said engine, the improvement comprising:

a heater having an inlet in fluid flow communication with the lower coolant chamber of said engine and an outlet connected to a high point of the lower coolant chamber of said engine;

a pump having a low pressure side connected to the lower coolant chamber of said engine and a high pressure side connected to both said radiator and to said heater; and a nonvariable in-line flow restrictor disposed between the high pressure side of said pump and said heater for limiting coolant pressure at all flow rates of said pump on said heater.

2. A heating system in accordance with claim 1 including an unrestricted fluid connection between the upper coolant chamber of said engine and the outlet of said radiator.

* * * * *